US009321080B2

(12) United States Patent
Takagi et al.

(10) Patent No.: US 9,321,080 B2
(45) Date of Patent: Apr. 26, 2016

(54) ELECTROMECHANICAL TRANSDUCER AND METHOD FOR DETECTING SENSITIVITY VARIATION OF ELECTROMECHANICAL TRANSDUCER

(75) Inventors: Makoto Takagi, Yokohama (JP); Masao Majima, Isehara (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 984 days.

(21) Appl. No.: 13/378,000

(22) PCT Filed: Jun. 18, 2010

(86) PCT No.: PCT/JP2010/060797

§ 371 (c)(1),
(2), (4) Date: Dec. 13, 2011

(87) PCT Pub. No.: WO2010/147239

PCT Pub. Date: Dec. 23, 2010

(65) Prior Publication Data

US 2012/0087205 A1 Apr. 12, 2012

(30) Foreign Application Priority Data

Jun. 19, 2009 (JP) ..... 2009-146937

(51) Int. Cl.
*B06B 1/02* (2006.01)

(52) U.S. Cl.
CPC ..... *B06B 1/0292* (2013.01); *B06B 1/0261* (2013.01)

(58) Field of Classification Search
CPC ..... B06B 1/0292; B06B 1/0261
See application file for complete search history.

(56) References Cited

U.S. PATENT DOCUMENTS

| | | | | |
|---|---|---|---|---|
| 6,328,696 | B1 * | 12/2001 | Fraser | 600/459 |
| 6,328,697 | B1 * | 12/2001 | Fraser | 600/459 |
| 6,443,901 | B1 * | 9/2002 | Fraser | 600/459 |
| 6,632,178 | B1 * | 10/2003 | Fraser | 600/459 |
| 7,615,834 | B2 * | 11/2009 | Khuri-Yakub et al. | 257/416 |
| 8,526,271 | B2 * | 9/2013 | Huang | 367/181 |
| 8,760,974 | B2 * | 6/2014 | Tanaka et al. | 367/174 |
| 2004/0130728 | A1 * | 7/2004 | Degertekin et al. | 356/505 |
| 2004/0236223 | A1 * | 11/2004 | Barnes et al. | 600/459 |
| 2004/0267134 | A1 * | 12/2004 | Hossack et al. | 600/459 |
| 2005/0177045 | A1 * | 8/2005 | Degertekin et al. | 600/457 |
| 2007/0057600 | A1 * | 3/2007 | Fukuda | B06B 1/0292 310/324 |
| 2007/0215964 | A1 * | 9/2007 | Khuri-Yakub et al. | 257/414 |
| 2008/0030101 | A1 * | 2/2008 | Funakubo | H01L 41/0913 310/316.02 |
| 2008/0064959 | A1 * | 3/2008 | Kanda et al. | 600/459 |
| 2008/0283945 | A1 * | 11/2008 | Kobayashi et al. | 257/416 |
| 2008/0294055 | A1 * | 11/2008 | Adachi et al. | 600/463 |

(Continued)

FOREIGN PATENT DOCUMENTS

| | | | |
|---|---|---|---|
| CN | 101227863 | A | 7/2008 |
| EP | 1897498 | A1 | 3/2008 |

(Continued)

*Primary Examiner* — Ari M Diacou
(74) *Attorney, Agent, or Firm* — Canon USA, Inc. IP Division

(57) ABSTRACT

An electromechanical transducer includes a plurality of elements each including a first electrode and a second electrode with a gap therebetween, a voltage applying unit configured to apply an AC voltage to the first electrode, and a sensitivity variation computing unit configured to compute a sensitivity variation for each of the elements using a signal output from the second electrode of the element due to the application of the AC voltage.

8 Claims, 7 Drawing Sheets

(56) References Cited

U.S. PATENT DOCUMENTS

| | | | | |
|---|---|---|---|---|
| 2010/0137719 | A1* | 6/2010 | Ikeda et al. | 600/459 |
| 2010/0244623 | A1* | 9/2010 | Huang | 310/300 |
| 2010/0256498 | A1* | 10/2010 | Tanaka | 600/459 |
| 2011/0071396 | A1* | 3/2011 | Sano et al. | 600/443 |
| 2011/0182149 | A1* | 7/2011 | Kandori | H04R 19/005 367/189 |
| 2011/0227448 | A1* | 9/2011 | Kandori | A61B 5/0095 310/300 |
| 2012/0038242 | A1* | 2/2012 | Tanaka et al. | 310/300 |
| 2012/0086307 | A1* | 4/2012 | Kandori | H02N 1/006 310/300 |
| 2012/0123268 | A1* | 5/2012 | Tanaka | B06B 1/0292 600/443 |

FOREIGN PATENT DOCUMENTS

| | | | | |
|---|---|---|---|---|
| EP | 1949856 | A1 | 7/2008 | |
| FR | 2553960 | A1 * | 4/1985 | G01H 3/00 |
| JP | 61-099862 | A | 5/1986 | |
| JP | 2004-125514 | A | 4/2004 | |
| JP | 2008-049408 | A | 3/2008 | |
| WO | 01/01730 | A | 1/2001 | |
| WO | 2005-032374 | A1 | 4/2005 | |
| WO | 2007-055320 | A1 | 5/2007 | |

* cited by examiner

ELECTROMECHANICAL TRANSDUCER AND METHOD FOR DETECTING SENSITIVITY VARIATION OF ELECTROMECHANICAL TRANSDUCER

TECHNICAL FIELD

The present invention relates to an electromechanical transducer and a method for detecting a sensitivity variation of an electromechanical transducer.

BACKGROUND ART

One of electromechanical transducers is a capacitive micromachined ultrasound transducer (CMUT). In general, CMUTs include a substrate having a lower electrode, a vibration membrane supported by a supporting unit formed on the substrate, and an upper electrode formed on the vibration membrane. The lower electrode faces the upper electrode with a gap therebetween. A structure including the vibration membrane, the upper electrode, and the lower electrode for a gap is referred to as a "cell", and one or more cells electrically connected to one another are referred to as an "element". In a CMUT, a vibration membrane is vibrated by received ultrasound waves, and the ultrasound waves are detected by using a variation in capacitance.

A CMUT includes an element array in which a plurality of elements are arranged in an array. Each of the elements transduces received elastic waves into an electrical signal. However, the characteristics of the elements differ from each other. The differences cause a variation in the sensitivity of CMUTs. In order to detect a variation in sensitivity, PTL 1, for example, describes a method for transmitting ultrasound waves having a single frequency from an ultrasound source. In PTL 1, each of the elements receives the ultrasound waves. By using electrical signals transduced by the plurality of elements, the sensitivities of the elements are detected.

Citation List

Patent Literature

PTL 1 Japanese Patent Laid-Open No. 2004-125514

SUMMARY OF INVENTION

In PTL 1, in order to drive the vibration membrane, ultrasound source is used. However, in order to receive ultrasound waves transmitted from the ultrasound source using an element array and compute sensitivity variations, the elements need to uniformly receive the ultrasound waves. However, ultrasound waves transmitted from an ultrasound source have directivity. In addition, the strength of the ultrasound waves received by each of the elements is affected by a medium between the ultrasound source and the element. For these reasons, it is difficult to transmit ultrasound waves having a uniform strength over a wide area. Accordingly, when the method for detecting sensitivity variations described in PTL 1 is applied to an element array having a wide receiving surface, the elements receive ultrasound waves having different strengths and, therefore, real sensitivity variations may not be detected. Accordingly, the present invention provides an electromechanical transducer capable of detecting sensitivity variations appearing in electrical signals on an element-by-element basis by uniformly applying signals to the elements regardless of the dimensions of a receiving surface.

According to an embodiment of the present invention, an electromechanical transducer includes a plurality of elements each including at least one cell, where the cell includes a first electrode and a second electrode with a gap therebetween, a voltage applying unit configured to apply an AC voltage to the first electrode, and a sensitivity variation computing unit configured to compute a sensitivity variation for each of the elements using a signal output from the second electrode of the element due to the application of the AC voltage.

According to the present invention, an electromechanical transducer can uniformly apply signals to the electromechanical transducer regardless of the dimensions of a signal receiving surface. Accordingly, sensitivity variations appearing in electrical signals on an element-by-element basis in the electromechanical transducer can be detected without taking into consideration variations in strengths of the applied signal.

DESCRIPTION OF EMBODIMENTS

Figure 1:
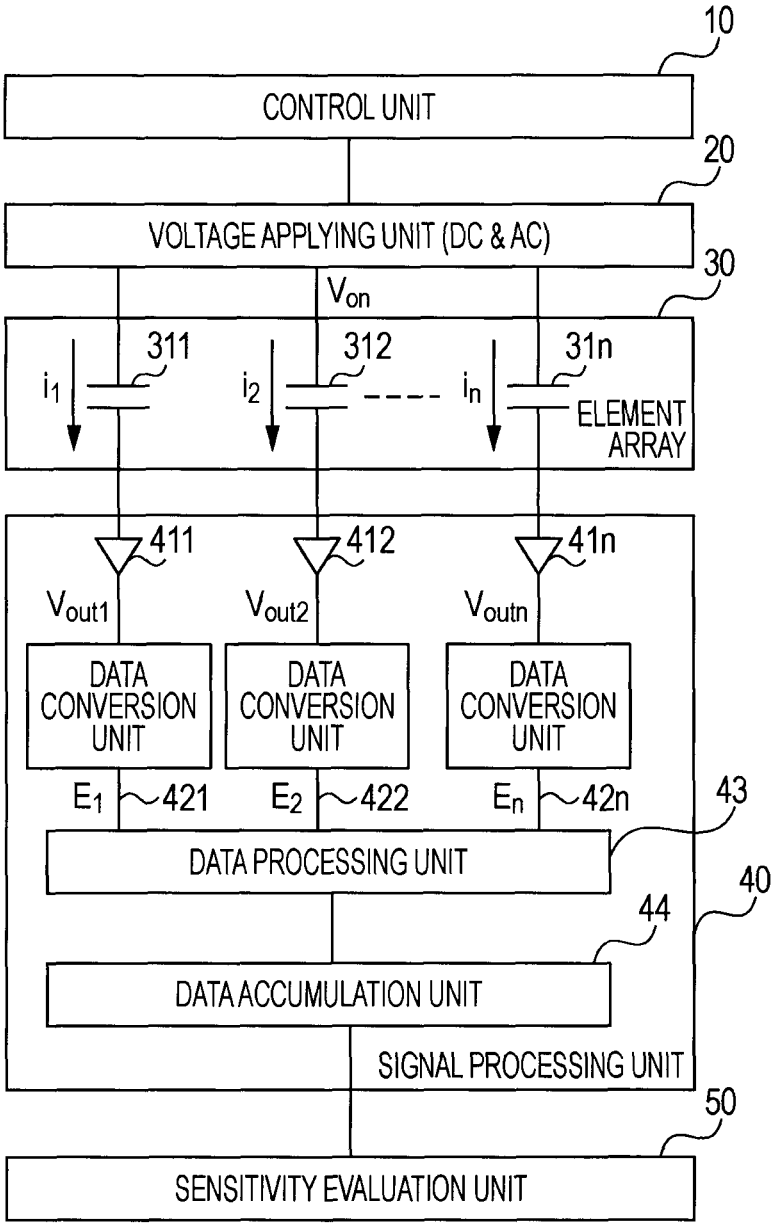
FIG. 1 illustrates an exemplary configuration of an electromechanical transducer according to the present invention.

According to the present invention, a distance between electrodes in each of electrode pairs is detected. Thereafter, sensitivity variations are detected using the differences. As used herein, the term "sensitivity" refers to an amount of electrical current output with respect to a displacement of a vibration membrane. That is, the term "sensitivity variation" refers to a ratio of an electrical current output before the vibration membrane is displaced to that after the vibration membrane is displaced for each of the electrode pairs. In addition, CMUTs include a plurality of cells. According to the present invention, an element includes one or more cells. More specifically, an element includes one cell or at least two cells electrically connected with each other (in parallel). When an element includes a plurality of cells, the cells may have different electrode-to-electrode distances. However, since an electrical current is output on an element-by-element basis, sensitivity variations on an element-by-element basis are important. That is, according to the present invention, an electrode-to-electrode distance for each of the cells is not detected, but a virtual electrode-to-electrode distance of the element is detected. That is, an element forms a capacitor.

An effect of an electrode-to-electrode distance on sensitivity variations is described next. In a structure in which a gap is formed between a pair of electrodes, an electrostatic capacitance C is expressed as follows:

$$C=\in_0\times\in\times S\times(1/d) \quad (1)$$

where d denotes an electrode-to-electrode distance, $\in_0$ denotes the dielectric constant of vacuum, $\in$ denotes the relative permittivity of a medium in the gap, and S denotes an electrode area. In a capacitive electromechanical transducer, one of the electrodes of the electrode pair is displaced by elastic waves, such as ultrasound waves. Thus, the electromechanical transducer outputs a current when the capacitance of the pair of electrode varies. Let V denote a potential difference between the pair of electrodes. Then, an amount of charge stored in an element that serves as a capacitor is expressed as follows:

$$Q=CV \quad (2)$$

At that time, an output current i is expressed as follows:

$$i=\Delta Q/\Delta t=-V\times\in_0\times\in\times S\times(1/d^2) \quad (3)$$

When elastic waves having a constant strength are received, the vibration membrane is displaced. As can be seen from equation (3), an amount of the output current for a small displacement is affected by the electrode-to-electrode distance d. That is, by detecting the electrode-to-electrode distance d, the sensitivity variations of the cells can be estimated. As used herein, the term "electrode-to-electrode distance d" refers to an electrode-to-electrode distance after the vibration membrane is displaced due to external pressure (e.g., air pressure) and an electrostatic attraction force generated by a direct current applied to the vibration membrane when used.

The capacitance of an element is determined by an area S, the electrode-to-electrode distance d, the dielectric constant of vacuum $\in_0$, and the relative permittivity $\in$ of a medium in the gap. However, an error in the electrode-to-electrode distance d occurs most frequently. This is because the electrode-to-electrode distance d is affected by the height of the gap (the height of the supporting unit) and, thus, it is difficult to produce an element having a constant gap height. In contrast, an element having a substantially correct area S can be produced by lithography, and the gap is maintained in a pressure substantially the same as that of vacuum. Accordingly, an error in the relative permittivity $\in$ of the medium negligibly occurs.

According to the present invention, by using the above-described characteristics, the capacitance C of each of the elements is measured, and the electrode-to-electrode distance d is detected. Thus, sensitivity variations of the elements are computed.

Figure 2:
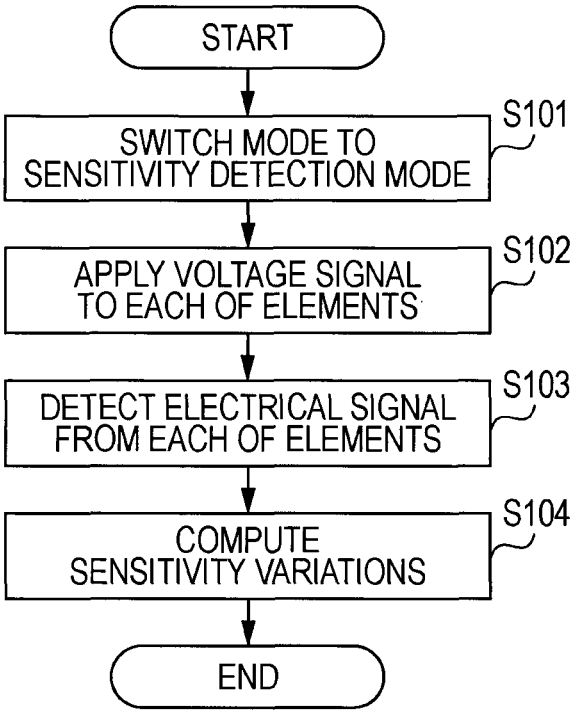
FIG. 2 is a flowchart of a method for detecting sensitivity variations for use in the electromechanical transducer according to the present invention.

The present invention is described in more detail below with reference to the accompanying drawings. FIG. 1 illustrates an exemplary configuration of an electromechanical transducer capable of detecting sensitivity variations according to the present invention. FIG. 2 is a flowchart of a method for detecting sensitivity variations for use in the electromechanical transducer according to the present invention.

The electromechanical transducer includes a control unit 10, a voltage applying unit 20, an element array 30 having a plurality of elements formed therein, a signal processing unit 40, and a sensitivity evaluation unit 50. The element array 30 includes n elements 311 to 31*n* each functioning as a capacitor. Such components of the electromechanical transducer are described in more detail below with reference to FIG. 1. Thereafter, operation steps of the method for detecting sensitivity variations are described with reference to FIG. 2.

The control unit 10 is connected to the voltage applying unit 20. The control unit 10 controls an applied voltage and switches between a detection mode in which normal elastic waves are detected and a measurement mode in which sensitivity variations are measured (step S101). The voltage applying unit 20 applies a DC voltage when the element array is driven and superimposes, on the DC voltage, an AC voltage having a predetermined frequency f and a voltage Vin (step S102). At that time, a current in accordance with the AC voltage is generated by each of the elements. This current is detected by the signal processing unit 40.

Figure 5:
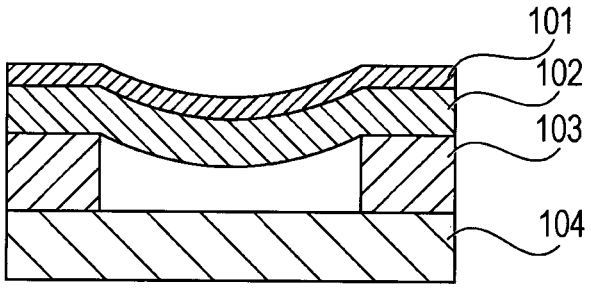
FIG. 5 illustrates an exemplary structure of a cell of the electromechanical transducer according to the present invention.

The voltage applying unit 20 is connected to a first electrode of each of the elements. The signal processing unit 40 is connected to a second electrode of the element. The second electrode faces the first electrode. As shown in FIG. 5, the first electrode is one of an upper electrode 101 and a lower electrode 104, while the second electrode is the other electrode. According to the present invention, a gap is formed between a pair of electrodes in each of the elements. Since the gap is formed, the vibration membrane moves when the vibration membrane receives elastic waves, such as ultrasound waves. Thus, the capacitance varies. As shown in FIG. 5, the upper electrode 101 may be formed on the vibration membrane. However, when the vibration membrane is formed of a semiconductor (e.g., Si) or a conductive material, the vibration membrane itself may function as the upper electrode 101.

The signal processing unit 40 includes amplifier circuits 411 to 41*n*, data conversion units 421 to 42*n*, a data processing unit 43, and a data accumulation unit 44. The data processing unit 43 is connected to a plurality of channels. For example, in one of the channels, a current output from an element 311 is converted into a voltage Vout by the amplifier circuit 411, and the analog voltage Vout is converted into a digital signal E1 by the data conversion unit 421. The data processing unit 43 acquires the converted digital signal E1 and computes the capacitance of the element 311 (step S103).

Let Vin denote the applied voltage, f denote the frequency, R (Ω) denote the transimpedance of an amplifier, and Vout denote the output voltage. Then, the capacitance of the element 311 is expressed as follows:

[Math. 1]

$$Cin=\frac{1}{2\pi fR}\times\frac{Vout}{Vin} \quad (4)$$

Similar processing is performed on each of the channels connected to the elements 311 to 31*n*. Thus, the capacitance values of the elements are computed using the digital signal E1 and digital signals E2 to En. The computed capacitance values are stored in the data accumulation unit 44.

The sensitivity evaluation unit 50 reads the capacitance values of the elements from the data accumulation unit 44. Thereafter, the sensitivity evaluation unit 50 computes the electrode-to-electrode distance d using the capacitance value and equation (1). Furthermore, by substituting the electrode-to-electrode distance d into equation (3), the sensitivity variation of each of the elements can be computed (step S104). That is, according to the present invention, the sensitivity evaluation unit 50 represents a sensitivity variation computing unit that computes the sensitivity variation of each of the elements.

As described above, according to the present invention, an AC voltage is applied to each of the elements, and the output current is detected. In this way, the signal can be uniformly applied to the entire element allay. Accordingly, the sensitivity variation of an element array having a large area can be detected without taking into account a variation in the applied signal.

In addition, the sensitivity can be correction using the detected sensitivity variation. In order to correct the sensitivity, the gain adjustment described in PTL 1 can be employed. More specifically, the gain of a programmable gain amplifier can be set for each of the elements so that the computed sensitivity variation is reduced.

First Embodiment

An electromechanical transducer and a method for detecting a sensitivity variation of the electromechanical transducer according to a first embodiment of the present invention is described below with reference to FIGS. 3 and 4.

Figure 3:
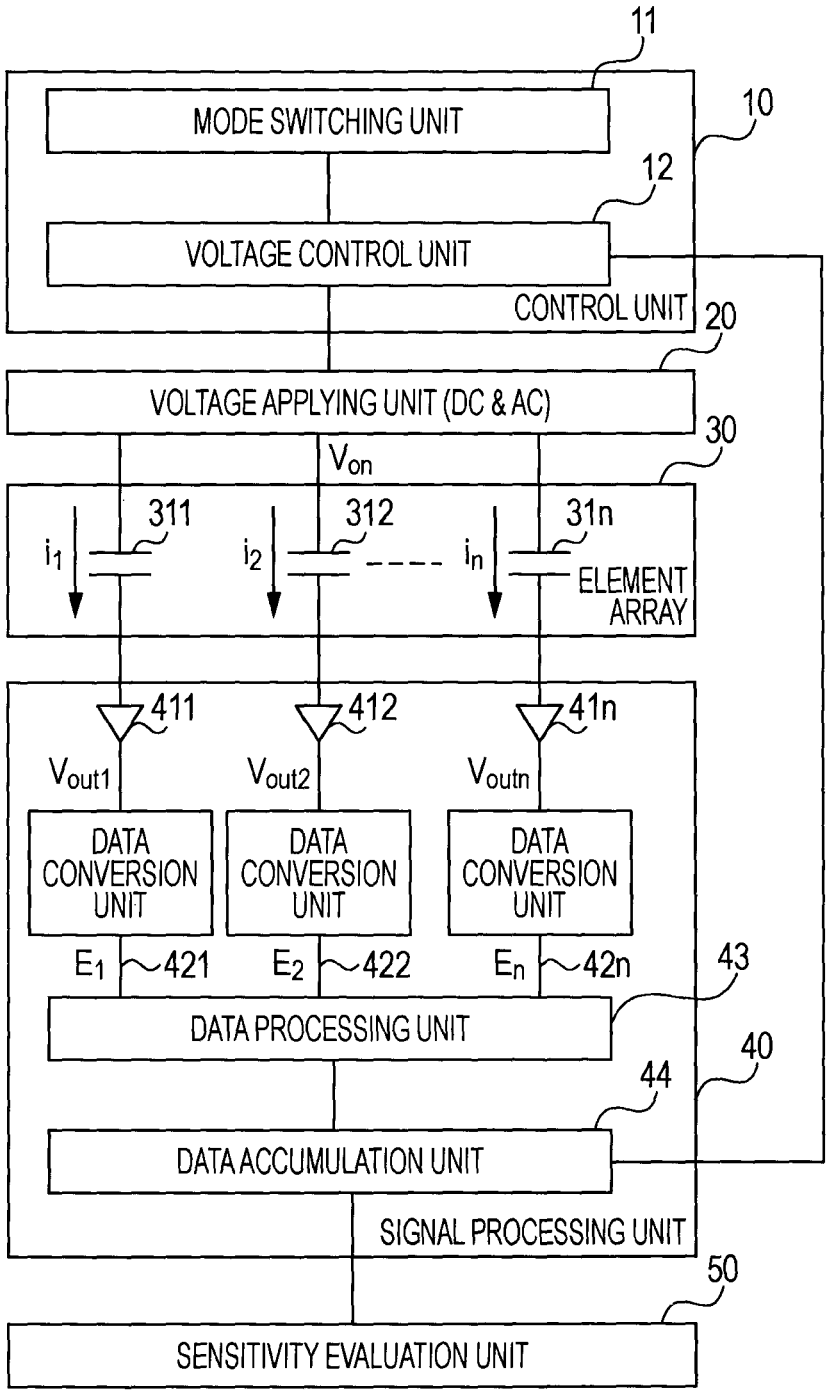
FIG. 3 illustrates an exemplary configuration of an electromechanical transducer according to a first embodiment of the present invention.
Figure 4:
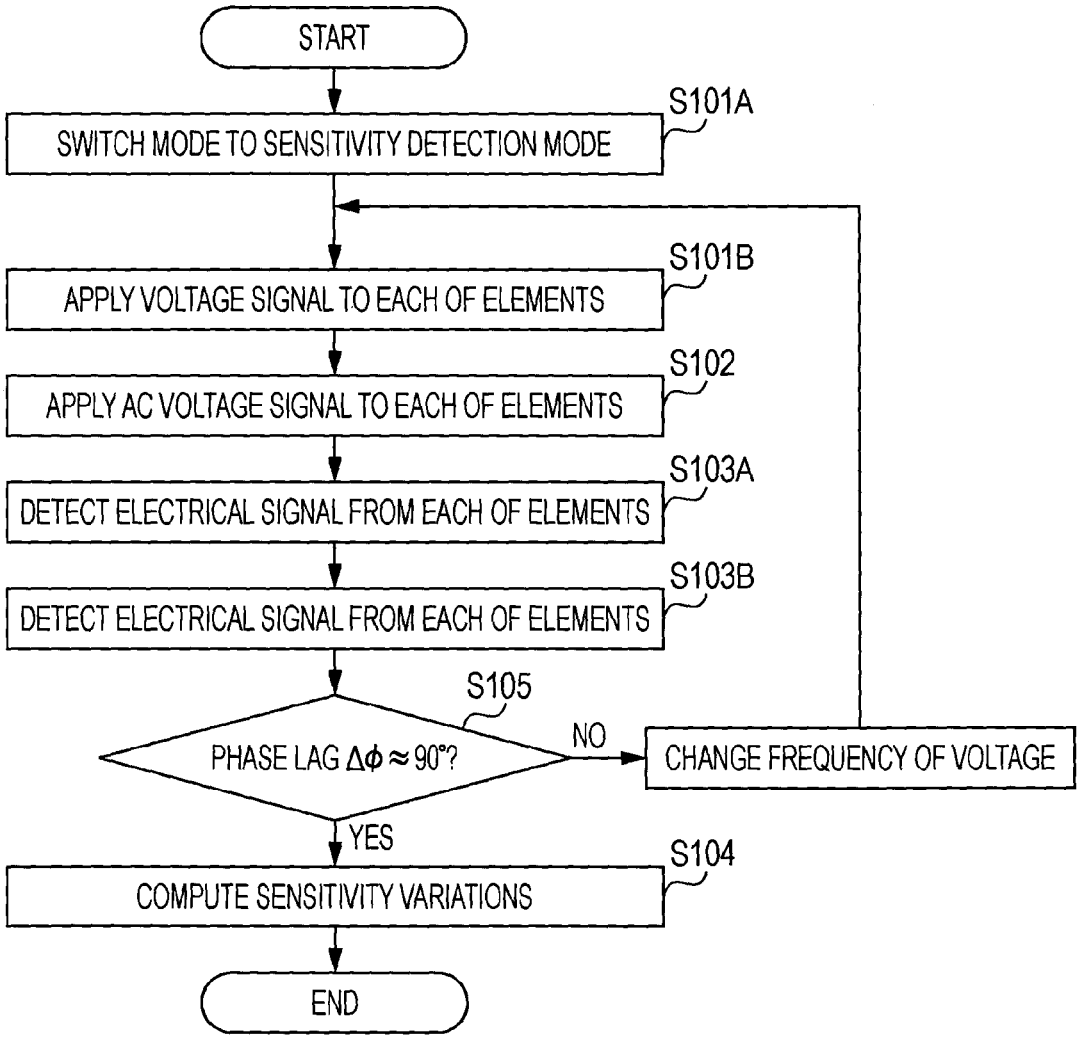
FIG. 4 is a flowchart of a method for detecting sensitivity variations for use in the electromechanical transducer according to the first embodiment of the present invention.

FIG. 3 illustrates an electromechanical transducer that detects sensitivity variations according to the present invention. FIG. 4 illustrates a method for detecting sensitivity variations for use in an electromechanical transducer according to the first embodiment of the present invention.

The electromechanical transducer includes the control unit 10, the voltage applying unit 20, and the element array 30, the signal processing unit 40, and the sensitivity evaluation unit 50. The control unit 10 includes a mode switching unit 11 that changes a mode to a sensitivity detection mode and a voltage control unit 12 that controls the frequency of the output voltage of the voltage applying unit 20. The function of the voltage control unit 12 is described in more detail below. The control unit 10 can be formed from an arithmetic processing unit, such as a central processing unit (CPU). The mode switching unit 11 changes a mode into a sensitivity detection mode (step S101A), and the voltage control unit 12 instructs the voltage applying unit 20 to generate an AC voltage (step S101B).

The voltage applying unit 20 generates a DC voltage (e.g., 50 V) usually applies to an element array and an AC voltage having, for example, a frequency of 10 MHz and a level of 20 mV (a peak-to-peak value) (step S102). The voltage applying unit 20 can be formed from an arbitrary waveform generator.

The element array 30 includes n elements 311 to 31*n* each functioning as a capacitor. The element array 30 outputs electrical current data to the signal processing unit 40. The signal processing unit 40 includes amplifier circuits 411 to 41*n*, data conversion units 421 to 42*n*, a data processing unit 43, and a data accumulation unit 44. The data processing unit 43 is connected to a plurality of channels. The amplifier circuits 411 to 41*n* are formed from transimpedance amplifiers. The transimpedance is, for example, 20 kΩ. In addition, each of the data conversion units 421 to 42*n* is formed from an analog-to-digital (AD) converter. The data processing unit 43 reads digital signals E1 to En output from the AD converters and detects the amplitude and the phase of each of the digital signals E1 to En (step S103A). In addition, the data processing unit 43 computes the capacitance values of the electrode pairs 311 to 31*n* using the detected amplitude and the phase of the digital signals E1 to En and stores the capacitance values in the data accumulation unit 44 (step S103B). At the same time, the phase information of each of the digital signals E1 to En is stored in the data accumulation unit 44. That is, the capacitance value of each of the electrode pairs 311 to 31*n* is stored in the data accumulation unit 44. The data processing unit 43 can be formed from an arithmetic processing unit, such as a CPU. In addition, the data accumulation unit 44 can be formed from a storage device, such as a semiconductor memory.

The function of the voltage control unit 12 is described next. The voltage control unit 12 is connected to the voltage applying unit 20. The voltage control unit 12 controls the frequency and the phase of the AC voltage. Accordingly, the voltage control unit 12 is connected to the data accumulation unit 44 disposed in the signal processing unit 40. The voltage control unit 12 compares a phase $\phi 1$ of a signal Vin output from the voltage applying unit 20 with a phase $\phi 2$ of the digital signals E1 to En stored in the data accumulation unit 44. Thereafter, the voltage control unit 12 controls the frequency of the voltage applied by the voltage applying unit 20 so that a phase difference $\Delta\phi$ between the phases $\phi 2$ and $\phi 1$ is about 90°. This is because, as described above, only the electrical impedance of the element without a mechanical vibration of the vibration membrane characteristic can be extracted by controlling the frequency, since a current output when the voltage is applied to the capacitor lags the frequency of the applied voltage by 90°.

The principal of this control is described in more detail next. According to the present embodiment, the electrode-to-electrode distance is estimated by computing the capacitance of the capacitor using the electrical impedance of the element. Thereafter, the sensitivity variation is computed using the electrode-to-electrode distance. Therefore, according to the present embodiment, in order to compute the electrical impedance, an AC voltage is applied, and a current output at that time is measured. Thus, the impedance of the element is estimated. However, in the electromechanical transducer according to the present invention, the element has a characteristic of a capacitor and a characteristic of a vibration membrane. Accordingly, the impedance estimated in the present embodiment is classified into electrical impedance and mechanical impedance.

When a sinusoidal AC voltage is applied to the capacitor, the phase lag is 90° since the current is proportional to a change in the voltage. In contrast, when a voltage signal having a frequency close to the resonant frequency is applied to an electromechanical transducer including a vibration membrane, the phase lag of the current is not 90° since the current output is affected by the mechanical impedance of the element caused by the characteristic of the vibration membrane. That is, if a current that does not have 90° phase lag from the phase of the applied voltage signal is detected, the impedance includes mechanical impedance. In order to estimate the sensitivity variation using the impedance computed using such a detected current, only electrical impedance needs to be retrieved.

According to the present embodiment, an AC voltage signal having a frequency (e.g., 1 MHz) different from the mechanical resonance frequency of the element (e.g., 10 MHz) is applied. Thus, only the electrical impedance can be detected without being affected by the mechanical impedance.

More specifically, the voltage control unit 12 compares the phase $\phi 1$ used by the voltage applying unit 20 with the phase $\phi 2$ stored in the data accumulation unit 44. If a phase lag between the phases $\phi 2$ and $\phi 1$ is about 90°, the processing proceeds to the next step. Otherwise, the voltage control unit 12 adjusts the frequency used in the voltage applying unit 20 and repeats steps S101B, S102, S103A, and S103B until the phase lag between the phases $\phi 2$ and $\phi 1$ is equal to about 90° (step S201).

Subsequently, the sensitivity evaluation unit 50 reads the capacitance values of the elements from the data processing unit 43 and computes the electrode-to-electrode distance d of each of the elements using the readout data and equation (4) (step S104A). Thereafter, a sensitivity variation of each of the elements is computed using the computed electrode-to-electrode distance d (step S104B). The sensitivity evaluation unit 50 can be formed from an arithmetic processing unit, such as a CPU.

As described above, according to the present embodiment, by applying an AC voltage to each of the elements and measuring the output current, the impedance of the element is computed. In addition, the voltage control unit 12 is provided in the control unit 10, and the frequency of the voltage applied by the voltage applying unit 20 is controlled so that a phase difference $\Delta\phi$ between the phase $\phi$1 of a signal output from the voltage applying unit 20 and the phase $\phi$2 of the signal stored in the data accumulation unit 44 is about 90°. In this way, the electrical impedance of the element can be measured without being affected by the dynamic mechanical characteristic of the vibration membrane and a sensitivity variation can be measured.

Second Embodiment

According to a second embodiment, an electromechanical transducer includes a sequence control unit 13. While varying the DC component of the voltage generated by the voltage applying unit 20, steps S101B to S105 described in the first embodiment are performed a plurality of times. Thus, a spring constant k of a vibration membrane is computed. This operation differs from that of the first embodiment.

As shown in FIG. 5, a vibration membrane 102 is supported by a supporting unit 103. A gap is formed between a pair of electrodes. Since the gap is formed, the vibration membrane 102 moves when elastic waves are received. Thus, the capacitance varies. After the vibration membrane 102 is deflected when the external air pressure is exerted and a DC voltage is applied, the electrode-to-electrode distance d is expressed as follows:

$$d=h-P\times S/k \tag{5}$$

where h denotes the height of the supporting unit 103, k denotes the spring constant of the vibration membrane 102, P denotes a pressure which is the sum of a difference in air pressure between the inside and the outside of the gap and the electrostatic attraction force caused by applying the DC voltage, and S denotes the area of the vibration membrane 102. Among these parameters, the height h of the supporting unit 103 and the spring constant k of the vibration membrane 102 may have variations on an element-by-element basis. That is, it is difficult to determine whether the variations in the electrode-to-electrode distance d on an element-by-element basis measured in the first embodiment are caused by variations in the height h of the supporting unit 103 on an element-by-element basis or variations in the spring constant k of the vibration membrane 102 on an element-by-element basis.

When the elastic waves are measured, the above-described value of the electrode-to-electrode distance d (when the vibration membrane 102 is deflected by the sum of the external air pressure and the electrostatic attraction force caused by applying the DC voltage) is further increased due to reception of the elastic waves. At that time, the spring constant k of the vibration membrane 102 affects the amount of displacement. Accordingly, by computing the spring constant k of the vibration membrane 102 in addition to the electrode-to-electrode distance d of the first embodiment, how easily vibration of the vibration membrane 102 starts can be determined. Thus, the sensitivity variation can be more accurately detected. This operation is described in more detail below.

As described above, the term "sensitivity" refers to the amount of output current with respect to the displacement of the vibration membrane. As indicated by equation (3), the output current is inversely proportional to $d^2$. In addition, the displacement of the vibration membrane is caused by an amount of change in pressure $\Delta P$ caused by reception of elastic waves. According to Hooke's law, $\Delta d$ is inversely proportional to k as follows:

$$\Delta d=\Delta P\times S/k \tag{6}$$

That is, since the displacement is inversely proportional to k, the sensitivity is affected by the spring constant k of the vibration membrane. According to the present embodiment, a table including a correspondence between the spring constant k and an error in the sensitivity actually measured is stored in advance and is used by the sensitivity evaluation unit 50 when the sensitivity is computed.

An electromechanical transducer and a method for detecting a sensitivity variation of the electromechanical transducer according to the second embodiment are described below with reference to FIGS. 6 and 7.

Figure 6:
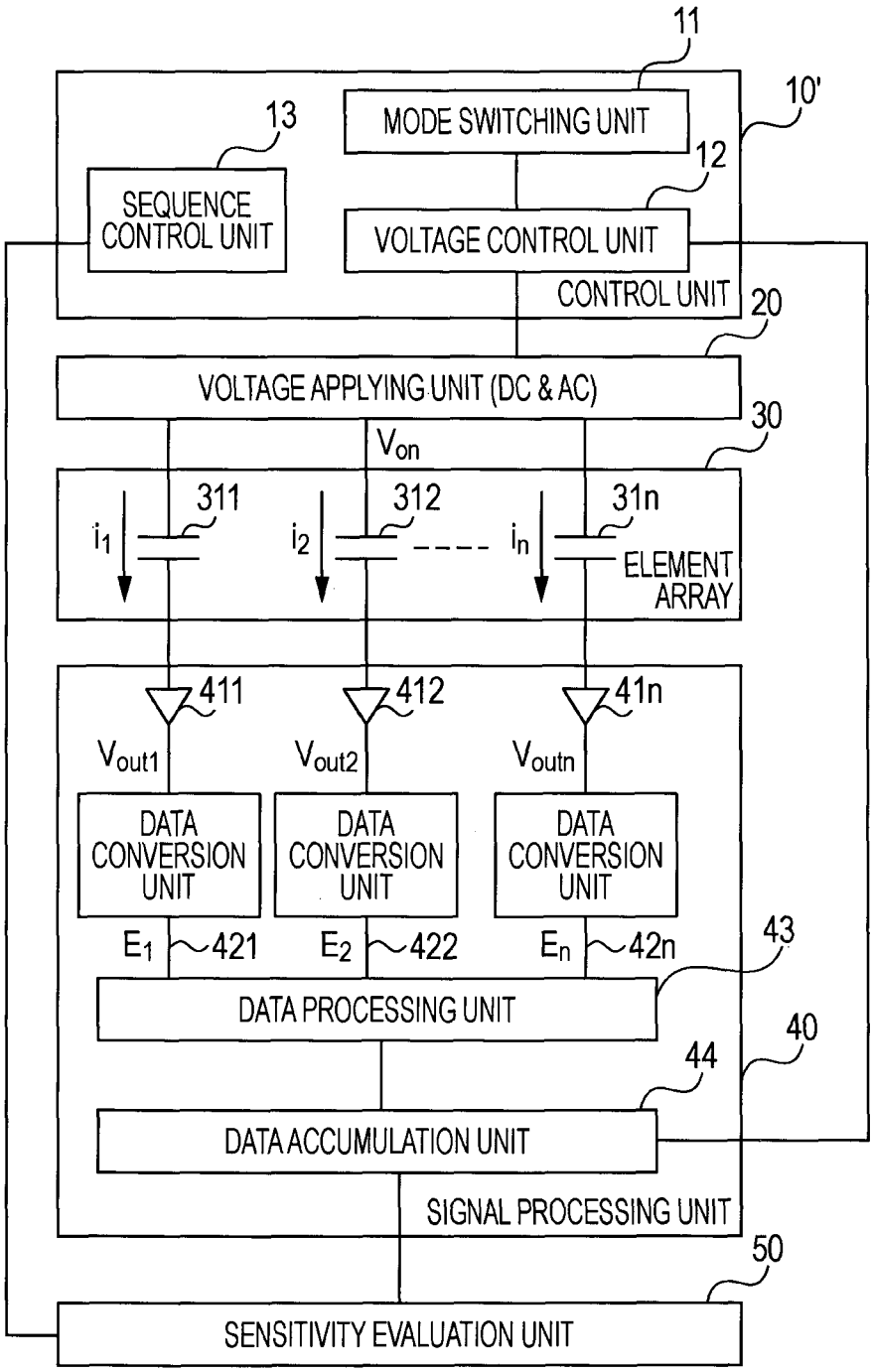
FIG. 6 illustrates an exemplary configuration of an electromechanical transducer that detects sensitivity variations according to a second embodiment of the present invention.

FIG. 6 illustrates an exemplary configuration of an electromechanical transducer according to the second embodiment. The same components as those illustrated and described in relation to the first embodiment are designated by the same reference numerals. The second embodiment differs from the first embodiment in that a control unit 10' incorporates the sequence control unit 13 that controls the sequence of the detecting processes in addition to the mode switching unit 11 and the voltage control unit 12.

Figure 7:
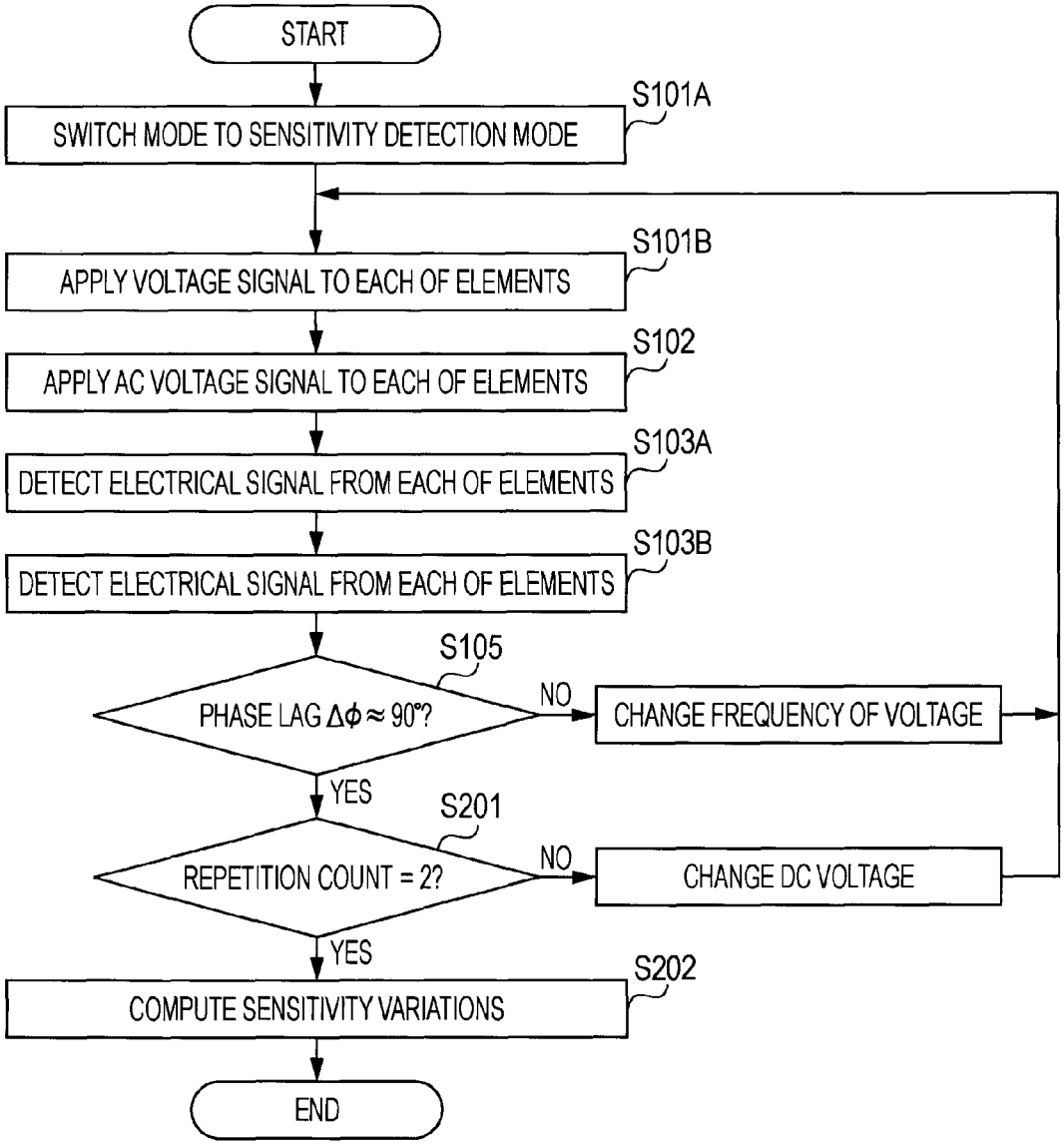
FIG. 7 is a flowchart of a method for detecting sensitivity variations for use in the electromechanical transducer according to the second embodiment of the present invention.

FIG. 7 is a flowchart of a method for detecting sensitivity variations for use in the electromechanical transducer according to the second embodiment. The same processes as those illustrated and described in relation to the first embodiment are designated by the same reference numerals. The second embodiment differs from the first embodiment in that a process for computing the sensitivity variation is performed a plurality of times (twice in the present embodiment) by varying a DC component of the voltage developed by the voltage applying unit 20 each time. Since the DC component of the voltage applied to the element is varied, the electrostatic attraction force exerted between the electrodes varies. Accordingly, the electrode-to-electrode distance d varies in accordance with the stiffness of the vibration membrane (i.e., the spring constant k of the vibration membrane). Therefore, by detecting the variation, the spring constant k of the vibration membrane can be computed.

According to the second embodiment, after the processes performed in steps S101B, S102, S103, and S105 are completed, the sequence control unit 13 counts a repetition count. If the repetition count reaches a predetermined count, the processing proceeds to step S104. However, if the repetition count has not reached the predetermined count, a DC component of the applied voltage is varied, and the processing returns to step S101B (step S201). This operation is repeated until the repetition count reaches m (m=2 in the present embodiment). Note that the DC component of the applied voltage that is varied each time the processes are repeated includes at least a DC voltage component applied when the electromechanical transducer is used.

Subsequently, for an xth element, electrode-to-electrode distances dx1 to dxm are computed. In addition, each time the processes are repeated, spring constants kx1 to kx(m−1) of the vibration membrane are computed by using the amount of change in electrostatic attraction force (computed from the DC component of the applied voltage), the amount of change in the electrode-to-electrode distances dx1 to dxm, and equation (6). At that time, the spring constant kx can be computed using the spring constants kx1 to kx(m−1) obtained by m repetitions for the xth element. According to the present embodiment, the average value of the spring constants kx1 to kx(m−1) is used as the spring constant kx.

This operation is performed for each of the first to nth elements. Thereafter, the sensitivity variations are computed using the computed electrode-to-electrode distances d1 to do and the spring constants k1 to kn of the vibration membrane (step S202). The affect of the electrode-to-electrode distance on the sensitivity is determined by using equation (3). In addition, the affect of the spring constants k1 to kn of the vibration membrane on the sensitivity can be computed by referring to a memory prestoring a correspondence between the spring constant k and an error in the sensitivity.

As described above, according to the second embodiment, the sequence control unit 13 that changes a DC voltage signal of the voltage applying unit 20 is provided. Therefore, the spring constant can be computed for each of the elements. In this way, even when the spring constant has distribution, the sensitivity variations on an element-by-element basis can be more accurately detected.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-146937, filed Jun. 19, 2009, which is hereby incorporated by reference herein in its entirety.

REFERENCE SIGNS LIST

10 control unit
11 mode switching unit
12 voltage control unit
13 sequence control unit
20 voltage applying unit
30 element array
311-31*n* element
40 signal processing unit
411-41*n* amplifier circuit
421-42*n* data conversion unit
43 data processing unit
44 data accumulation unit
50 sensitivity evaluation unit

The invention claimed is:

1. An electromechanical transducer comprising:

a plurality of elements each including at least one cell, the cell including a first electrode and a second electrode with a gap therebetween, the cell comprising a vibration membrane that has one of the first and second electrodes;

a voltage applying unit configured to apply an AC voltage to the first electrode of each of the elements; and a sensitivity variation computing unit configured to compute a sensitivity variation for each of the elements using a signal output from the second electrode of the element due to the application of the AC voltage, wherein the voltage applying unit applies the AC voltage having a frequency that is different from a mechanical resonance frequency of the vibration membrane, and further comprising a control unit configured to switch between a mode of the electromechanical transducer in which the sensitivity variation is computed and a mode in which elastic waves are detected.

wherein the control unit includes an amplifier circuit configured to convert the electrical current into a voltage and a data conversion unit configured to convert the voltage output from the amplifier circuit into a digital signal, and wherein the control unit controls a frequency of the AC voltage applied by the voltage applying unit based on a difference in phase between the AC voltage and the digital signal.

2. The electromechanical transducer according to claim 1, wherein the control unit controls a frequency of the AC voltage applied by the voltage applying unit so that a difference in phase between the AC voltage and the digital signal is substantially 90°.

3. The electromechanical transducer according to claim 1, wherein the control unit alters a DC voltage applied by the voltage applying unit and detects the electrical current a plurality of times.

4. A method for detecting a sensitivity variation for use in an electromechanical transducer, the electromechanical transducer having a plurality of elements each including at least one cell, the cell including a first electrode and a second electrode with a gap therebetween, the method comprising the steps of:

applying a DC voltage and an AC voltage to the first electrode;

computing a sensitivity variation for each of the elements using a signal output from the second electrode of the element due to the application of the AC voltage, wherein applying comprises applying the AC voltage having a frequency that is different from a mechanical resonance frequency of the vibration membrane; and switching between a mode of the electromechanical transducer in which the sensitivity variation is computed and a mode in which elastic waves are detected, wherein switching comprises converting the electrical current into a voltage, converting the voltage output from the amplifier circuit into a digital signal, and controlling a frequency of the applied AC voltage unit based on a difference in phase between the AC voltage and the digital signal.

5. The method according to claim 4, further comprising the step of:

controlling a frequency of the AC voltage so that a difference in phase between the AC voltage and a digital signal digital-converted in the step of detecting an electrical current and performing signal processing is substantially 90°.

6. The method according to claim 4, wherein at least the first to third steps are performed a plurality of times while altering the DC voltage.

7. The electromechanical transducer according to claim 3, wherein the control unit alters a DC voltage applied by the voltage applying unit and detects the electrical current a plurality of times.

8. The method according to claim 5, wherein at least the first to third steps are performed a plurality of times while altering the DC voltage.

* * * * *